US011428120B1

(12) United States Patent
Girard et al.

(10) Patent No.: US 11,428,120 B1
(45) Date of Patent: Aug. 30, 2022

(54) DAMPING BRACKET FOR A GAS TURBINE ENGINE

(71) Applicant: Pratt & Whitney Canada Corp., Longueuil (CA)

(72) Inventors: Julien Girard, Saint-Julie (CA); Mateusz Pelc, Rzeszow (PL)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 17/392,656

(22) Filed: Aug. 3, 2021

(51) Int. Cl.

| | |
|---|---|
| ***F01D 25/04*** | (2006.01) |
| ***F01D 25/28*** | (2006.01) |
| ***F01D 25/24*** | (2006.01) |
| ***F01D 9/06*** | (2006.01) |

(52) U.S. Cl.
CPC ..... *F01D 25/04* (2013.01); *F01D 9/06* (2013.01); *F01D 25/243* (2013.01); *F01D 25/28* (2013.01); *F05D 2240/14* (2013.01); *F05D 2260/31* (2013.01); *F05D 2260/96* (2013.01)

(58) Field of Classification Search
CPC ..... F01D 25/04; F01D 25/14; F01D 25/24; F01D 25/28; F05D 2240/14; F05D 2260/21
See application file for complete search history.

(56) References Cited

U.S. PATENT DOCUMENTS

| | | | | |
|---|---|---|---|---|
| 4,441,323 | A * | 4/1984 | Colley | F23R 3/283 60/737 |
| 5,313,780 | A | 5/1994 | Williams | |
| 5,369,952 | A | 12/1994 | Walters | |
| 2005/0271494 | A1 | 12/2005 | Hidalgo | |
| 2014/0227093 | A1* | 8/2014 | Barry | F02K 1/822 415/213.1 |
| 2018/0187571 | A1* | 7/2018 | Recuero | F02C 7/32 |
| 2018/0355762 | A1* | 12/2018 | Tripodina | F01D 11/24 |
| 2020/0109643 | A1 | 4/2020 | Silva | |

* cited by examiner

*Primary Examiner* — David E Sosnowski
*Assistant Examiner* — Maxime M Adjagbe
(74) *Attorney, Agent, or Firm* — Getz Balich LLC

(57) ABSTRACT

An assembly is provided for a turbine engine. This assembly includes a static structure, a conduit and a conduit bracket. The static structure includes a port. The conduit extends longitudinally through the port. The conduit bracket couples the conduit to the static structure. The conduit bracket includes a base mount, a conduit mount and a damper. The base mount is attached to the static structure. The conduit mount is attached to the conduit. The damper is between the base mount and the conduit mount. The damper includes a first leg, a second leg and a web. The first leg projects laterally out from the base mount. The second leg projects laterally out from the conduit mount. The web is longitudinally between and connected to the first leg and the second leg.

20 Claims, 9 Drawing Sheets

DAMPING BRACKET FOR A GAS TURBINE ENGINE

BACKGROUND OF THE DISCLOSURE

1. Technical Field

This disclosure relates generally to a turbine engine and, more particularly, to arranging a conduit with a static structure of the turbine engine.

2. Background Information

A gas turbine engine may include a static structure and a fluid conduit which passes radially through the static structure from an exterior of the static structure to an interior of the static structure. A bracket may be connected to the static structure and the fluid conduit for preventing large displacements between the static structure and the fluid conduit. While known brackets have various advantages, there is still room in the art for improvement. For example, slight rubbing between the bracket and the fluid conduit may cause damage (e.g., fretting) to the fluid conduit.

SUMMARY OF THE DISCLOSURE

According to an aspect of the present disclosure, an assembly is provided for a turbine engine. This turbine engine assembly includes a static structure of the turbine engine, a conduit and a conduit bracket. The static structure includes a port. The conduit extends longitudinally through the port. The conduit bracket couples the conduit to the static structure. The conduit bracket includes a base mount, a conduit mount and a damper. The base mount is attached to the static structure. The conduit mount is attached to the conduit. The damper is between the base mount and the conduit mount. The damper includes a first leg, a second leg and a web. The first leg projects laterally out from the base mount. The second leg projects laterally out from the conduit mount. The web is longitudinally between and connected to the first leg and the second leg.

According to another aspect of the present disclosure, a bracket is provided for mounting a conduit to a component of a turbine engine. This bracket includes a first base mount, a second base mount, a conduit mount, a first damper and a second damper. The first base mount is configured to mechanically fasten to a first side of the component. The second base mount is configured to mechanically fasten to a second side of the component. The conduit mount includes an aperture configured to receive the conduit therethrough. The conduit mount is configured to mechanically fasten to the conduit. The first damper is between and connected to the first base mount and the conduit mount. The second damper is between and connected to the second base mount and the conduit mount. The second damper is angularly offset from the first damper by an angle between forty-five degrees and one-hundred and thirty-five degrees.

According to still another aspect of the present disclosure, another bracket is provided for mounting a conduit to a component of a turbine engine. This bracket includes a first base mount, a second base mount, a conduit mount and a damper. The first base mount includes a first fastener aperture. The first base mount is configured to mechanically fasten to a first side of the component. The second base mount includes a second fastener aperture. The second base mount is configured to mechanically fasten to a second side of the component. The conduit mount includes an aperture configured to receive the conduit therethrough. The conduit mount is configured to mechanically fasten to the conduit. The damper is between and connected to the first base mount, the second base mount and the conduit mount. At least the first base mount, the second base mount, the conduit mount and the damper are configured together as a monolithic body.

At least the first base mount, the second base mount, the conduit mount, the first damper and the second damper may be configured together as a monolithic body.

The damper may include a first leg, a second leg and a web between the first leg and the second leg. The first leg may project out from the first base mount and the second base mount to a first leg end. The second leg may project out from the conduit mount to a second leg end. The web may be connected to the first leg at the first leg end. The web may be connected to the second leg at the second leg end.

The static structure may be configured as or otherwise include a turbine exhaust case.

The static structure may include a turbine engine case and a base bracket. The port may extend through a sidewall of the turbine engine case. The base bracket may be connected to the sidewall of the turbine engine case. The conduit bracket may be attached to the base bracket.

The base bracket may include a second port. The conduit may extend longitudinally through the second port.

The base bracket may include a base bracket first mount, a base bracket second mount and a channeled segment. The base bracket first mount may be attached to the turbine engine case. The base bracket second mount may be attached to the turbine engine case. The channeled segment may be laterally between and/or connected to the base bracket first mount and the base bracket second mount. The base mount may be attached to a lateral side of the channel segment.

The first leg may be parallel with the second leg.

The first leg may be longitudinally spaced from and/or may laterally overlap the second leg.

The web may be configured with a curved cross-sectional geometry.

The base mount may be configured as or otherwise include a base mount flange mechanically fastened to the static structure.

The base mount may also include an extension that projects laterally and/or longitudinally out from the base mount flange to the first leg.

The conduit bracket may also include a second base mount. A portion of the static structure may be laterally between and/or mechanically fastened to the base mount and the second base mount.

The base mount may include a first base mount flange and a first extension. The first extension may project laterally and/or longitudinally out from the first base mount flange to a first side of the first leg. The second base mount may include a second base mount flange and a second extension. The second extension may project laterally and/or longitudinally out from the second base mount flange to a second side of the first leg.

The conduit bracket may also include a second base mount and a second damper. The second base mount may be attached to the static structure. The second damper may be between the second base mount and the conduit mount. The second damper may include a second damper first leg, a second damper second leg and a second damper web. The second damper first leg may project laterally out from the second base mount. The second damper second leg may project laterally out from the conduit mount. The second damper web may be longitudinally between and/or connected to the second damper first leg and the second damper second leg.

A centerline of the damper may be angularly offset from a centerline of the second damper by an angle greater than zero degrees and less the one-hundred and eighty degrees.

The conduit mount may include a second port. The conduit may extend longitudinally through the second port.

The conduit mount may include a channel. The conduit may extend longitudinally through the channel.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
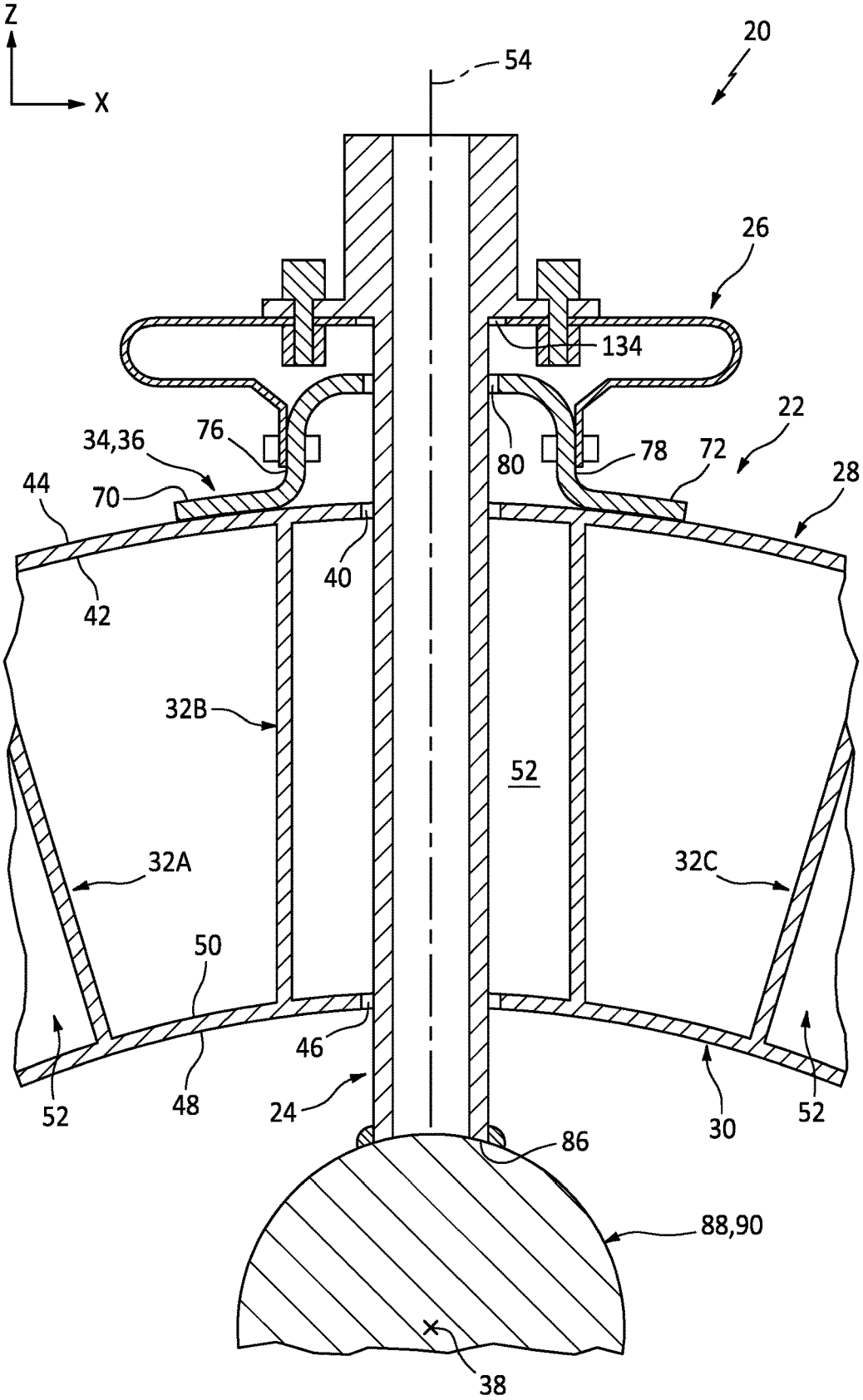
FIG. 1 is a simplified, schematic cross-sectional illustration of a portion of an assembly for a turbine engine.

FIG. 1 illustrates an assembly 20 for a turbine engine. This turbine engine assembly 20 includes a static structure 22, a fluid conduit 24 and a conduit bracket 26.

The static structure 22 may be any static (e.g., stationary) structure of the turbine engine. The static structure 22, for example, may be configured as or otherwise include a turbine exhaust case (TEC). In another example, the static structure 22 may be configured as or otherwise include a turbine support structure (e.g., a mid-turbine frame) or a compressor support structure (e.g., a mid-compressor frame). In still another example, the static structure 22 may be configured as a simple case or wall of the turbine engine through which the fluid conduit 24 may pass. The present disclosure, of course, is not limited to the foregoing exemplary static structure configurations.

The static structure 22 of FIG. 1 includes an outer turbine engine case 28 ("outer case"), an inner turbine engine case 30 ("inner case") and one or more turbine engine vanes (e.g., 32A-C; generally referred to as "32"); e.g., hollow guide vanes. The static structure 22 of FIG. 1 also includes a mount 34 for the conduit bracket 26. For ease of description, the mount 34 is described below as a base bracket 36. However, it is contemplated the conduit bracket mount 34 may alternatively be configured as or otherwise include another component of the static structure 22 such as, but not limited to, a hollow mounting boss.

The outer case 28 of FIG. 1 extends axially along and circumferentially about (e.g., completely around) an axial centerline 38 of the turbine engine, which axial centerline 38 may also be a rotational axis for one or more components within the turbine engine. The outer case 28 of FIG. 1 includes an outer case port 40; e.g., an aperture such as a through hole. This outer case port 40 extends radially through the outer case 28 between an inner side 42 of the outer case 28 and an inner side 22 of the outer case 28.

The inner case 30 of FIG. 1 extends axially along and circumferentially about (e.g., completely around) the axial centerline 38. The inner case 30 of FIG. 1 includes an inner case port 46; e.g., an aperture such as a through hole. This inner case port 46 extends radially through the inner case 30 between an inner side 48 of the inner case 30 and an outer side 50 of the inner case 30. The inner case port 46 may be (e.g., axially and/or circumferentially) aligned with the outer case port 40. For example, a centerline of the inner case port 46 may be coaxial with a centerline of the outer case port 40; however, the present disclosure is not limited thereto.

The vanes 32 are arranged circumferentially about the axial centerline 38 in an annular array. This annular array of the vanes 32 is disposed radially between the outer case 28 and the inner case 30. Each of the vanes 32 of FIG. 1 extends radially between and is connected to the outer case 28 and the inner case 30. Each of the vanes 32 of FIG. 1 is configured as a hollow vane. Each of the vanes 32 of FIG. 1, for example, has a vane passage 52 (e.g., bore) which extends radially through the respective vane 32. The vane passage 52 of a first of the vanes 32B ("first vane") is (e.g., axially and/or circumferentially) aligned with the outer case port 40 and the inner case port 46. The first vane passage 52 is thereby radially between and fluidly coupled with the outer case port 40 and the inner case port 46.

Figure 2:
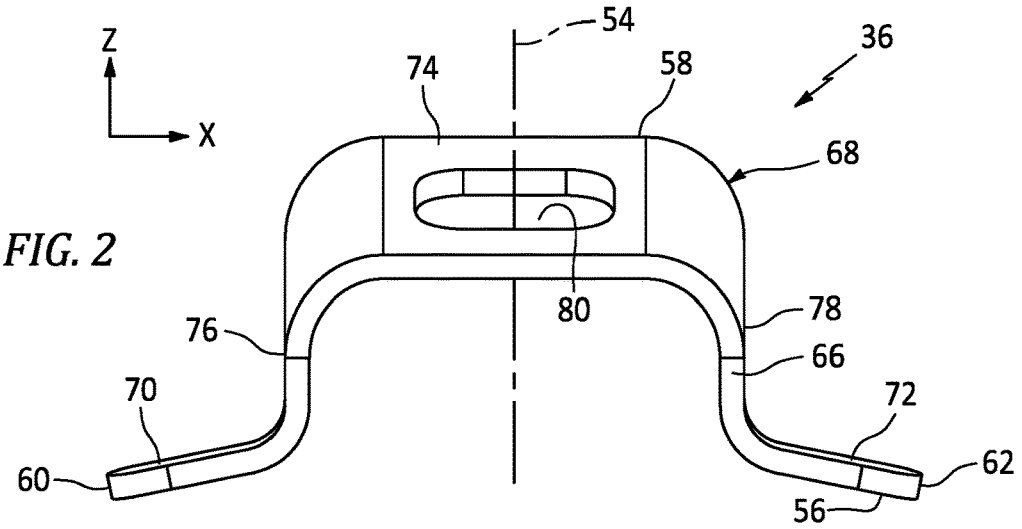
FIGS. 2-4 are illustrations of different views of a base bracket.
Figure 3:
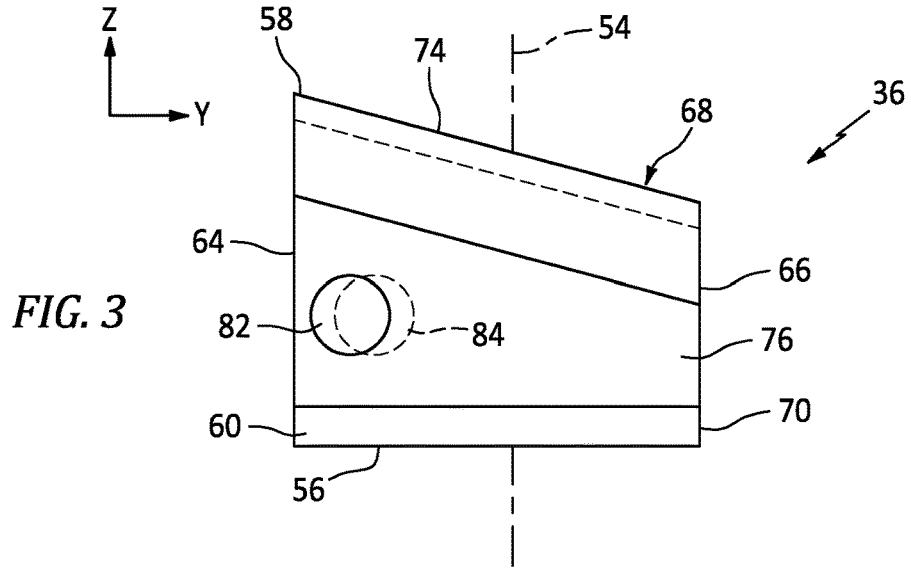
Figure 4:
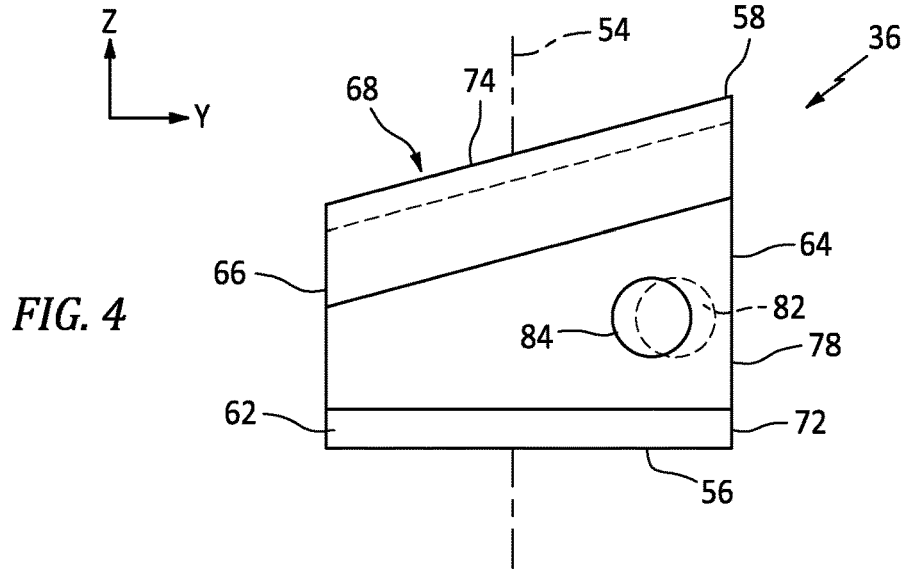

Referring to FIGS. 2-4, the base bracket 36 extends longitudinally in a longitudinal direction (e.g., a z-axis direction) along a z-axis (e.g., along a longitudinal centerline 54 of the fluid conduit 24) between and to an inner side 56 of the base bracket 36 and an outer side 58 of the base bracket 36. The base bracket 36 extends laterally in a first lateral direction (e.g., an x-axis direction) along an x-axis (e.g., circumferentially or tangentially relative to the axial centerline 38) between and to opposing lateral sides 60 and 62 of the base bracket 36. The base bracket 36 extends laterally in a second lateral direction (e.g., a y-axis direction) along a y-axis (e.g., axially relative to the axial centerline 38) between and to opposing lateral sides 64 and 66 of the base bracket 36. Note, the term "lateral" may be used herein to generally describe the first lateral direction, the second lateral direction and/or any other direction within the x-y plane.

The base bracket 36 may be configured as a (e.g., flanged) channeled bracket; e.g., a top-hat bracket. The base bracket 36 of FIGS. 2-4, for example, includes an intermediate channeled segment 68, a first mount 70 and a second mount 72.

The channeled segment 68 includes a web 74, a first leg 76 and a second leg 78. The channeled segment web 74 extends laterally (e.g., in the x-axis direction) between and is connected to the base bracket first mount 70 and the base bracket second mount 72. The channeled segment web 74 is located at (e.g., on, adjacent or proximate) the base bracket outer side 58. The channeled segment web 74 includes a base bracket port 80; e.g., an aperture such as a through-hole, a channel or a notch. This base bracket port 80 extends longitudinally through the channeled segment web 74, where a centerline of the base bracket port 80 may be coaxial with the longitudinal centerline 54.

The channeled segment first leg 76 of FIGS. 2 and 3 is located at a first lateral side of and is connected to the channeled segment web 74. The channeled segment first leg 76 projects longitudinally (e.g., radially inward) from the channeled segment web 74 to the base bracket first mount 70 at the base bracket inner side 56. The channeled segment first leg 76 of FIG. 3 is configured with a first mounting aperture 82; e.g., a fastener aperture. This first mounting aperture 82 extends laterally (e.g., in the x-axis direction) through the channeled segment first leg 76.

The channeled segment second leg 78 of FIGS. 2 and 4 is located at a second lateral side of and is connected to the channeled segment web 74. The channeled segment second leg 78 projects longitudinally (e.g., radially inward) from the channeled segment web 74 to the base bracket second mount 72 at the base bracket inner side 56. The channeled segment second leg 78 of FIG. 4 is configured with a second mounting aperture 84; e.g., a fastener aperture. This second mounting aperture 84 extends laterally (e.g., in the x-axis direction) through the channeled segment second leg 78. A centerline of the second mounting aperture 84 may be offset (e.g., laterally in the y-axis direction) from a centerline of the first mounting aperture 82; however, the present disclosure is not limited thereto.

The base bracket first mount 70 of FIGS. 2 and 3 is located at the base bracket inner side 56. The base bracket first mount 70 projects laterally (e.g., in the x-axis direction) out from the channeled segment 68 to the base bracket first lateral side 60.

The base bracket second mount 72 of FIGS. 2 and 4 is located at the base bracket inner side 56. The base bracket second mount 72 projects laterally (e.g., in the x-axis direction) out from the channeled segment 68 to the base bracket second lateral side 62.

Referring to FIG. 1, the base bracket 36 is arranged with the outer case 28. The base bracket 36 of FIG. 1, for example, is located on the outer case outer side 44. Each of the base bracket mounts 70, 72 is connected to the outer case 28. Each of the base bracket mounts 70, 72, for example, may be bonded (e.g., welded or brazed) to the outer case 28 at its outer side 44. The present disclosure, however, is not limited to such an exemplary connection technique.

The fluid conduit 24 extends along its longitudinal centerline 54. An inner end 86 of the fluid conduit 24 is connected to an inner structure 88 of the turbine engine (schematically shown). The fluid conduit inner end 86, for example, may be connected (e.g., brazed or otherwise bonded) to and fluidly coupled with a bearing support structure 90. The fluid conduit 24 projects longitudinally along its longitudinal centerline 54 out from its inner end 86 and sequentially through the apertures 46, 52, 40 and 80. The fluid conduit 24 may thereby pass (e.g., radially relative to the axial centerline 38) from an interior of the static structure 22 to an exterior of the static structure 22.

The conduit bracket 26 is configured to provide a damped mechanical coupling between the fluid conduit 24 and the static structure 22 (e.g., the base bracket 36 of the static structure 22). The conduit bracket 26, for example, is configured to damp transmission of vibrations between the fluid conduit 24 and the static structure 22, while still allowing slight relative movement between the fluid conduit 24 and the static structure 22. The conduit bracket 26 is also configured to reduce or prevent unintended contact (e.g., rubbing) between the fluid conduit 24 and other components of the turbine engine assembly 20; e.g., 22, 28, 34 and 36. Note, the fluid conduit 24 may float within the apertures 46, 52, 40 and 80 so as not to contact the components 22, 28, 34 and 36.

Referring to FIGS. 5-8, the conduit bracket 26 extends longitudinally in the longitudinal direction (e.g., the z-axis direction) along the z-axis (e.g., along the longitudinal centerline 54 of the fluid conduit 24) between and to an inner side 92 of the conduit bracket 26 and an outer side 94 of the conduit bracket 26. The conduit bracket 26 extends laterally in the first lateral direction (e.g., the x-axis direction) along the x-axis (e.g., circumferentially or tangentially relative to the axial centerline 38) between and to opposing lateral sides 96 and 98 of the conduit bracket 26. The conduit bracket 26 extends laterally in the second lateral direction (e.g., the y-axis direction) along the y-axis (e.g., axially relative to the axial centerline 38) between and to opposing lateral sides 100 and 102 of the conduit bracket 26. The conduit bracket 26 of FIGS. 5-8 includes one or more base mounts 104 and 105, a conduit mount 106 and one or more (e.g., spring) dampers 107 and 108.

Figure 5:
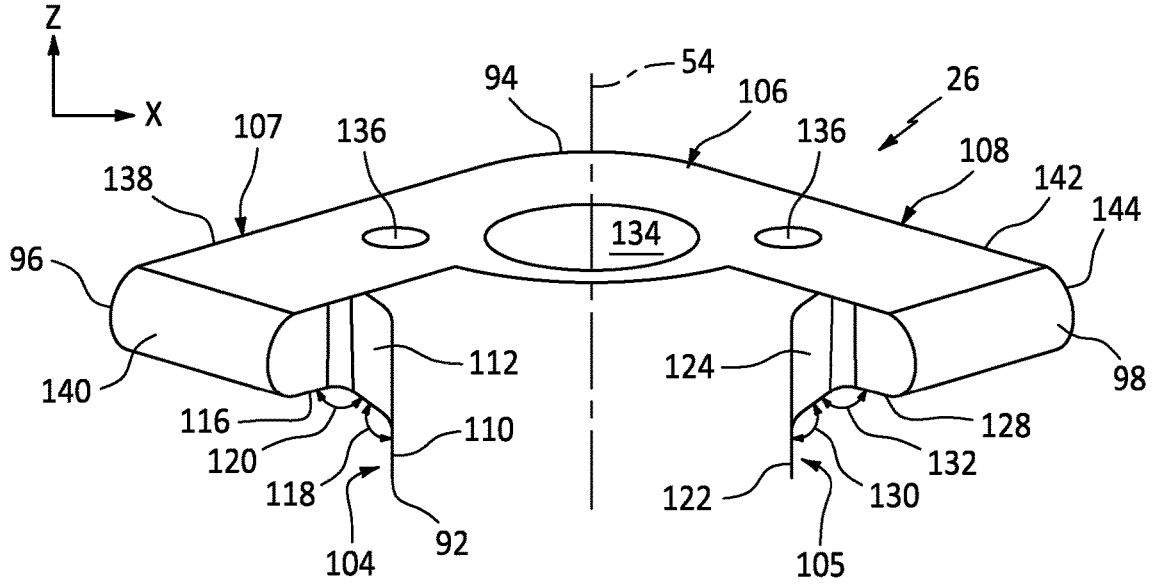
FIGS. 5-8 are illustrations of different views of a conduit bracket.
Figure 7:
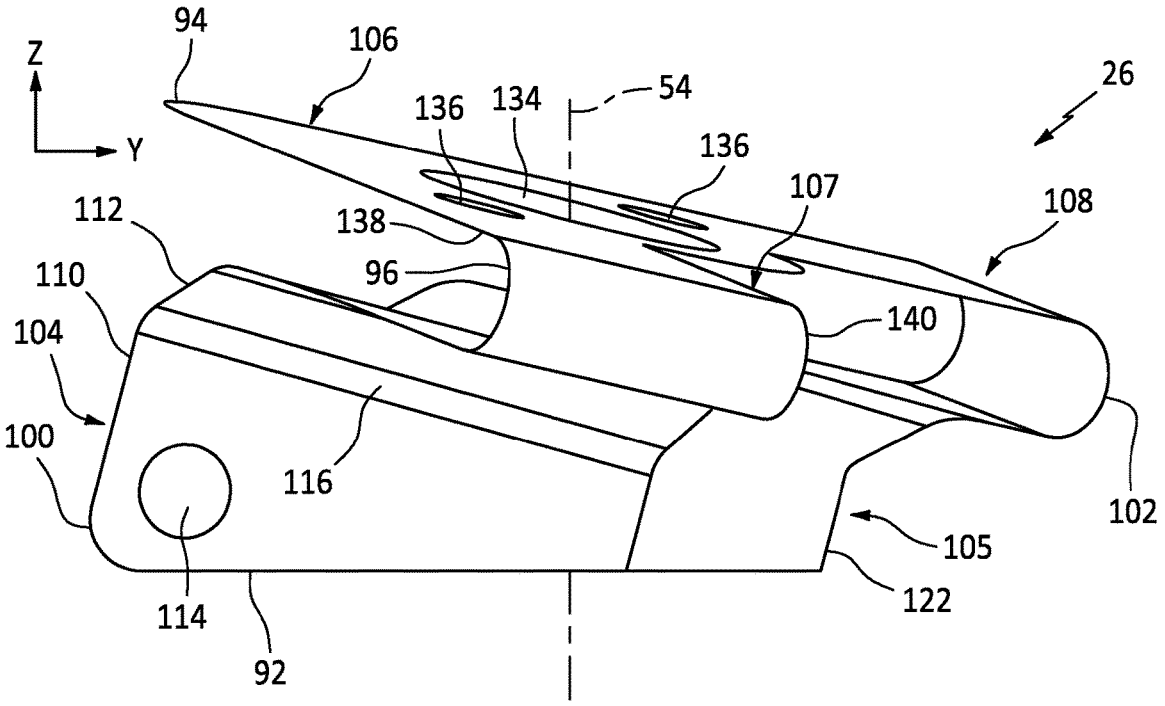

The first base mount 104 of FIGS. 5 and 7 includes a first base mount flange 110 and a first base mount extension 112; e.g., an offset. The first base mount flange 110 may lay in a plane substantially parallel with a y-z plane. The first base mount flange 110 projects longitudinally out (e.g., radially inward relative to the axial centerline 38) from the first base mount extension 112 to a distal first end of the first base mount 104 at the conduit bracket inner side 92. The first base mount 104 of FIG. 7 is configured with a first mounting aperture 114; e.g., a fastener aperture. This first mounting aperture 114 extend laterally (e.g., in the x-axis direction) through the first base mount 104.

The first base mount extension 112 connects the first base mount 104 to the first damper 107. The first base mount extension 112 of FIG. 5 extends laterally (e.g., in the x-axis direction) and longitudinally between and to the first base mount 104 and an inner leg 116 of the first damper 107. The first base mount extension 112 of FIG. 5 is angularly offset from the first base mount 104 by an included angle 118; e.g., an obtuse angle less than one-hundred and eighty degrees. The first base mount extension 112 of FIG. 5 is angularly offset from the first damper inner leg 116 by an included angle 120; e.g., an obtuse angle less than one-hundred and eighty degrees.

Figure 8:
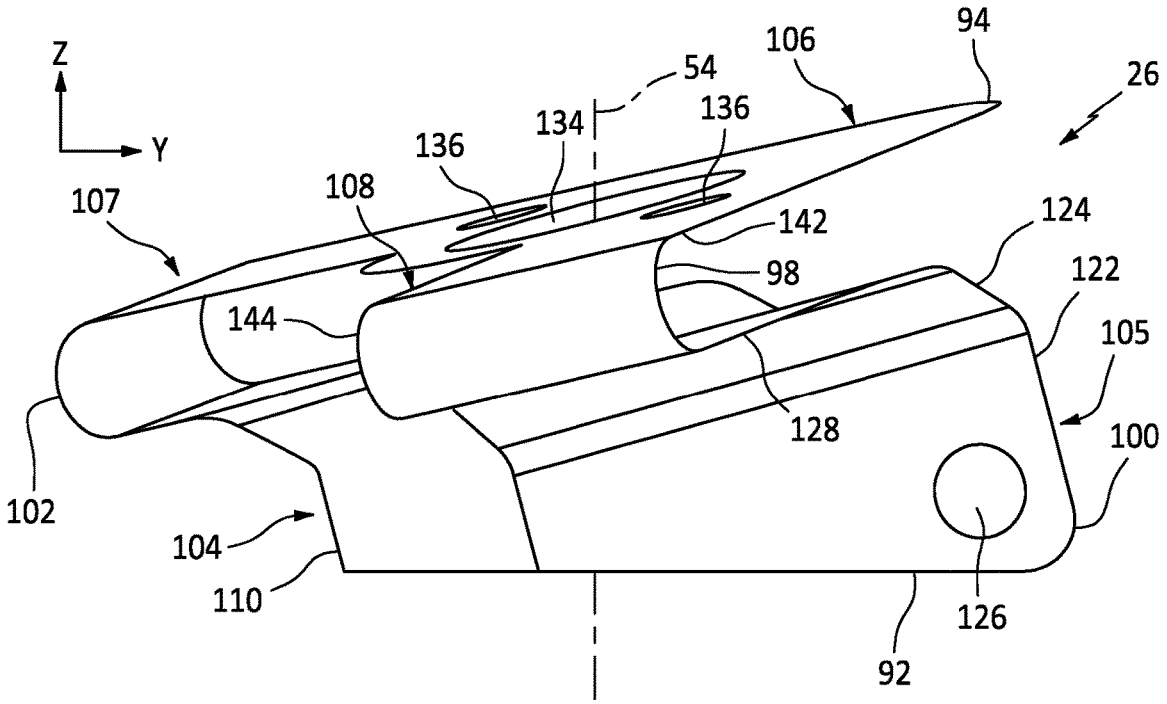

The second base mount 105 of FIGS. 5 and 8 includes a second base mount flange 122 and a second base mount extension 124; e.g., an offset. The second base mount flange 122 may lay in a plane substantially parallel with a y-z plane. The second base mount flange 122 projects longitudinally out (e.g., radially inward relative to the axial centerline 38) from the second base mount extension 124 to a distal second end of the second base mount 105 at the conduit bracket inner side 92. The second base mount 105 of FIG. 8 is configured with a second mounting aperture 126; e.g., a fastener aperture. This second mounting aperture 126 extend laterally (e.g., in the x-axis direction) through the second base mount 105. A centerline of the second mounting aperture 126 may be offset (e.g., laterally in the y-axis direction) from a centerline of the first mounting aperture 114; however, the present disclosure is not limited thereto.

The second base mount extension 124 connects the second base mount 105 to the second damper 108. The second base mount extension 124 of FIG. 5 extends laterally (e.g., in the x-axis direction) and longitudinally between and to the second base mount 105 and an inner leg 128 of the second damper 108. The second base mount extension 124 of FIG. 5 is angularly offset from the second base mount 105 by an included angle 130; e.g., an obtuse angle less than one-hundred and eighty degrees. The second base mount extension 124 of FIG. 5 is angularly offset from the second damper inner leg 128 by an included angle 132; e.g., an obtuse angle less than one-hundred and eighty degrees.

Figure 9:
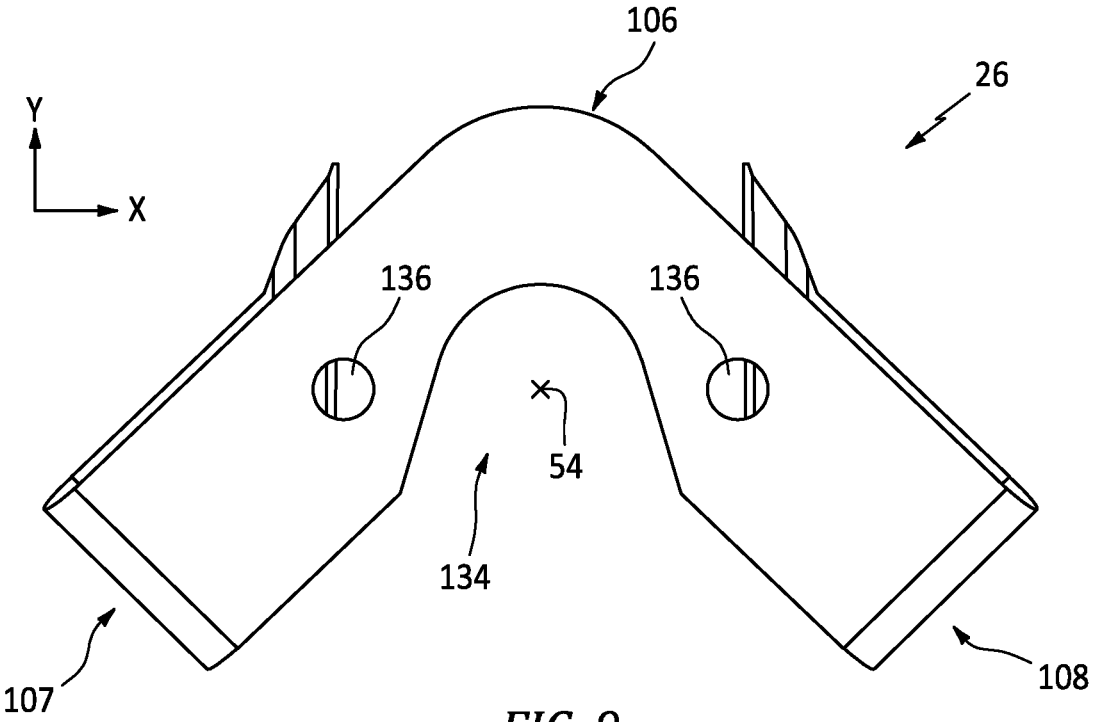
FIG. 9 is an illustration of the conduit bracket with a channel.

The conduit mount 106 may lay in a plane perpendicular to the base mounts 104, 105. The conduit mount 106 of FIGS. 5, 7 and 8, for example, is parallel with the x-axis and slightly angularly offset from the y-axis depending on the specific orientation of the conduit bracket 26. The conduit mount 106 of FIG. 6 includes a conduit mount port 134; e.g., an aperture such as a through-hole (or a channel; see FIG. 9). This conduit mount port 134 extends longitudinally along the longitudinal centerline 54 through the conduit mount 106. The conduit mount port 134 may have a round (e.g., circular, elliptical, etc.) cross-sectional geometry, a polygonal (e.g., square, rectangular, etc.) cross-sectional geometry, or a combination thereof such as a polygonal cross-sectional geometry with rounded corners (e.g., a rounded-square). The conduit mount port 134 may be configured with or without an undercut. The conduit mount 106 of FIG. 6 also includes one or more mounting apertures 136; e.g., fastener apertures. These mounting apertures 136 are arranged on opposing lateral sides (e.g., along the x-axis) of the conduit mount port 134. Each of the mounting apertures 136 extends longitudinally through the conduit mount 106.

The first damper 107 may be configured as a spring damper. The first damper 107 of FIGS. 5 and 7, for example, includes the inner leg 116, an outer leg 138 and a web 140. The first damper inner leg 116 projects laterally out from the first base mount 104 and its extension 112 to an end of the first damper inner leg 116. The first damper outer leg 138 projects laterally out from the conduit mount 106 to an end of the first damper outer leg 138. The first damper web 140 is arranged between the first damper inner leg 116 and the first damper outer leg 138. The first damper web 140 extends longitudinally between the first damper inner leg 116 and the first damper outer leg 138. More particularly, the first damper web 140 is connected to the first damper inner leg 116 at its end, and the first damper web 140 is connected to the first damper outer leg 138 at its end. The first damper web 140 thereby couples the first damper legs 116 and 138 together such that (A) the first damper inner leg 116 is longitudinally spaced from the first damper outer leg 138, and (B) the first damper inner leg 116 and the first damper outer leg 138 laterally overlap; e.g., along the x-axis and/or along the y-axis. The first damper web 140 of FIG. 5 has a curved (e.g., semi-circular or otherwise arcuate) cross-sectional geometry when viewed, for example, in a plane parallel with and/or coincident with the longitudinal centerline 54.

The second damper 108 may be configured as a spring damper. The second damper 108 of FIGS. 5 and 8, for example, includes the inner leg 128, an outer leg 142 and a web 144. The second damper inner leg 128 projects laterally out from the second base mount 105 and its extension to an end of the second damper inner leg 128. The second damper outer leg 142 projects laterally out from the conduit mount 106 to an end of the second damper outer leg 142. The second damper web 144 is arranged between the second damper inner leg 128 and the second damper outer leg 142. The second damper web 144 extends longitudinally between the second damper inner leg 128 and the second damper outer leg 142. More particularly, the second damper web 144 is connected to the second damper inner leg 128 at its end, and the second damper web 144 is connected to the second damper outer leg 142 at its end. The second damper web 144 thereby couples the second damper legs 128 and 142 together such that (A) the second damper inner leg 128 is longitudinally spaced from the second damper outer leg 142, and (B) the second damper inner leg 128 and the second damper outer leg 142 laterally overlap; e.g., along the x-axis and/or along the y-axis. The second damper web 144 of FIG. 5 has a curved (e.g., semi-circular or otherwise arcuate) cross-sectional geometry when viewed, for example, in a plane parallel with and/or coincident with the longitudinal centerline 54.

Figure 6:
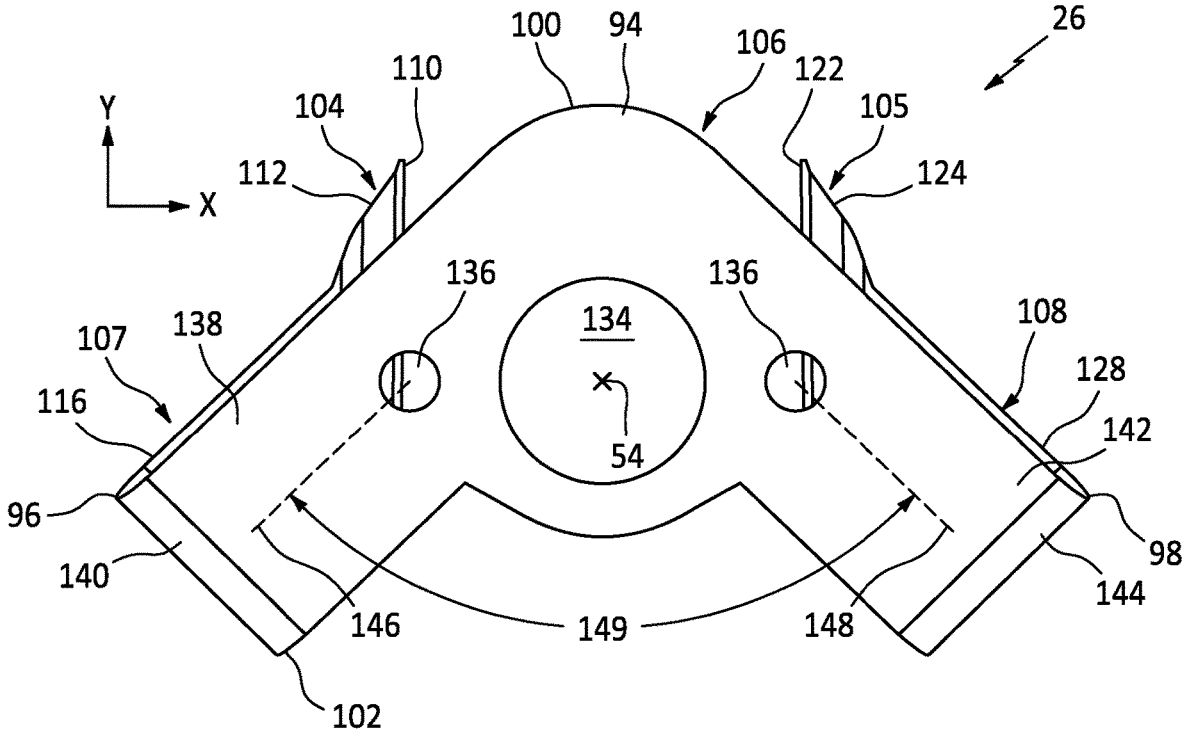

Referring to FIG. 6, the first damper 107 projects laterally out from the conduit mount 106 and the first base mount 104 along a first damper centerline 146. Similarly, the second damper 108 projects laterally out from the conduit mount 106 and the first base mount 104 along a second damper centerline 148. The second damper centerline 148 may be non-parallel the first damper centerline 146. The second damper centerline 148 and, thus, the second damper 108 of FIG. 6, for example, is angularly offset from the first damper centerline 146 and, thus, the first damper 107 by an included angle 149. This included angle 149 may be less than one-hundred and eighty degrees and greater than zero degrees; e.g., between forty-five degrees and one-hundred and thirty-five degrees. The included angle 149 of FIG. 6, for example, exactly or about (e.g., +/−1 degree) ninety degrees.

The conduit bracket 26 of FIGS. 5-8 may be configured as a monolithic body. At least the conduit bracket components 104-108, for example, may be formed together as a single, unitary body. The conduit bracket 26, for example, may be formed from a shaped and bent piece of sheet metal. In another example, the conduit bracket 26 may be machined form a lump mass of material; e.g., metal. The present disclosure, however, is not limited to the foregoing exemplary formation techniques nor conduit bracket materials. The conduit bracket 26, for example, may also or alternatively be formed from a polymer and/or a composite material. Furthermore, in other embodiments, any two or more of the conduit bracket components 104-108 may be discretely formed and then attached together to provide the conduit bracket 26 with a non-monolithic body.

Figure 10:
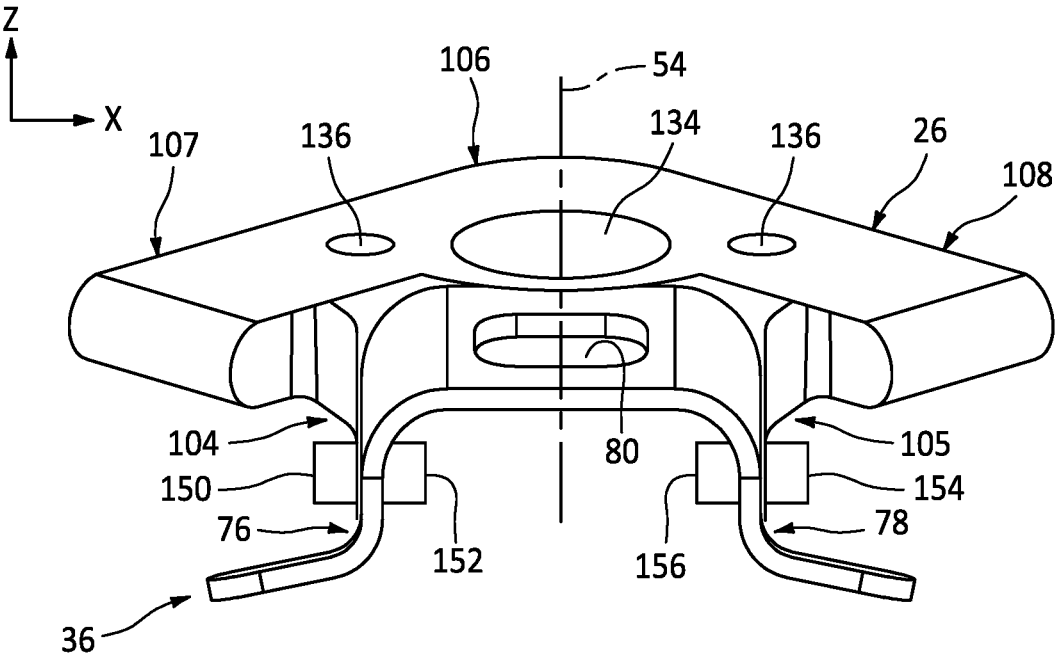
FIG. 10 is an illustration of the conduit bracket attached to the base bracket.

Referring to FIG. 10, the conduit bracket 26 is connected to the base bracket 36 and, thus, the static structure 22 (see FIG. 1). The base bracket 36, for example, is arranged laterally (e.g., along the x-axis) between the base mounts 104 and 105. The first base mount 104 is attached (e.g., mechanically fastened) to the channeled segment first leg 76 towards the first side of the base bracket 36. A fastener 150 (e.g., a bolt), for example, may project through the first mounting apertures 82 and 114 (see FIGS. 3 and 7) and be secured with a nut 152. The second base mount 105 is attached (e.g., mechanically fastened) to the channeled segment second leg 78 towards the second side of the base bracket 36. A fastener 154 (e.g., a bolt), for example, may project through the second mounting apertures 84 and 126 (see FIGS. 4 and 8) and be secured with a nut 156. Note, because the first mounting apertures 82 and 114 are offset from the second mounting apertures 84 and 126 as described above, the fasteners 150 and 154 may securely fix the conduit bracket 26 to the base bracket 36 without, for example, pivoting about the fasteners 150 and 154.

Figure 11:
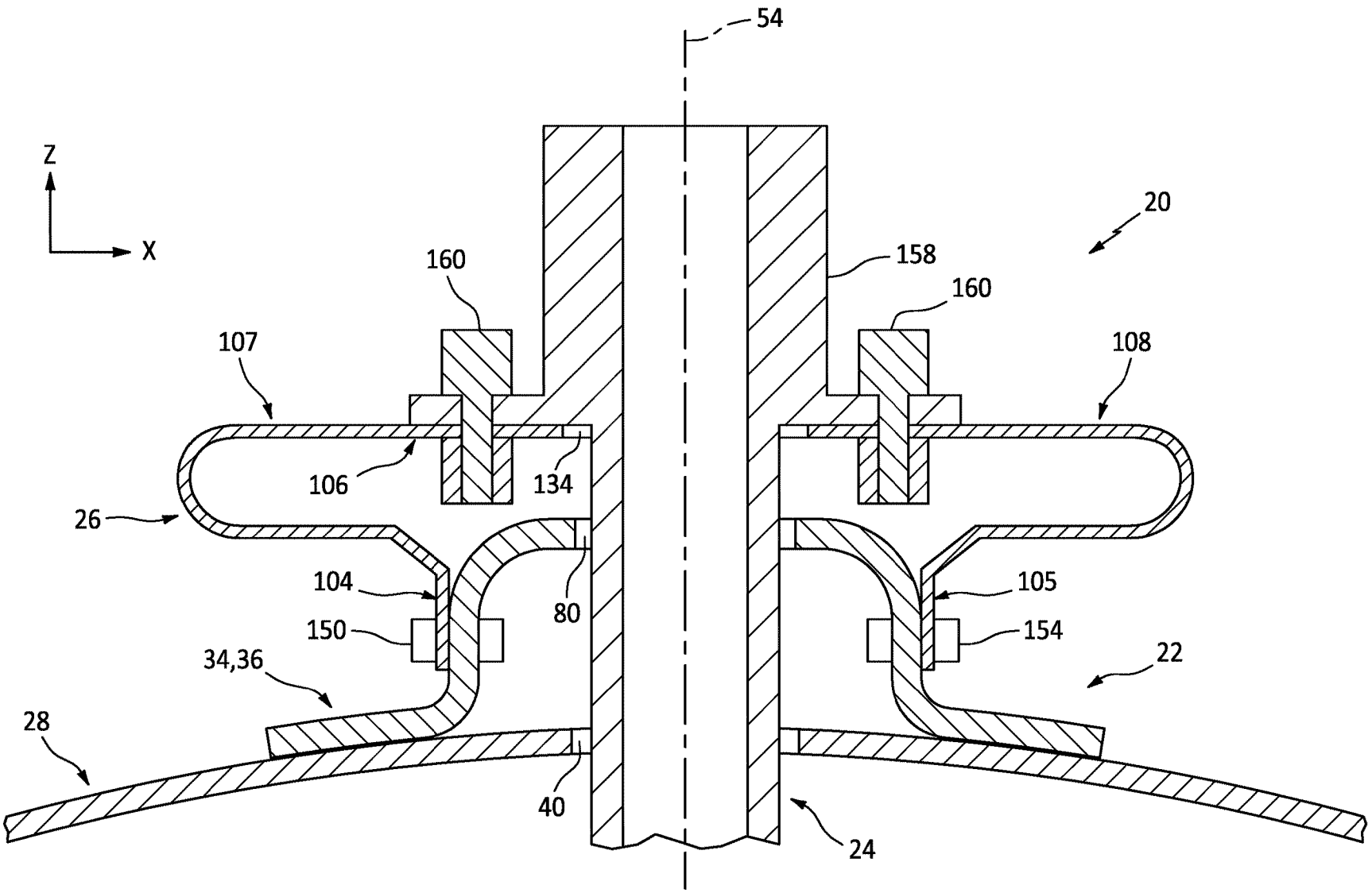
FIG. 11 is a simplified, schematic sectional illustration of a damped coupling between a fluid conduit and a static structure through the conduit bracket.

Referring to FIG. 11, the fluid conduit 24 passes longitudinally through the conduit mount port 134 along its longitudinal centerline 54. A fixture 158 on the fluid conduit 24 (e.g., a conduit coupling) may be connected (e.g., mechanically fastened) to the fluid conduit 24. Fasteners 160

(e.g., bolts), for example, may respectively project longitudinally through mounting apertures in the fixture 158 and the mounting apertures 136 (see FIG. 6) in the conduit mount 106. The fluid conduit 24 and its fixture 158 may thereby be fixedly secured to the conduit mount 106.

Figure 12:
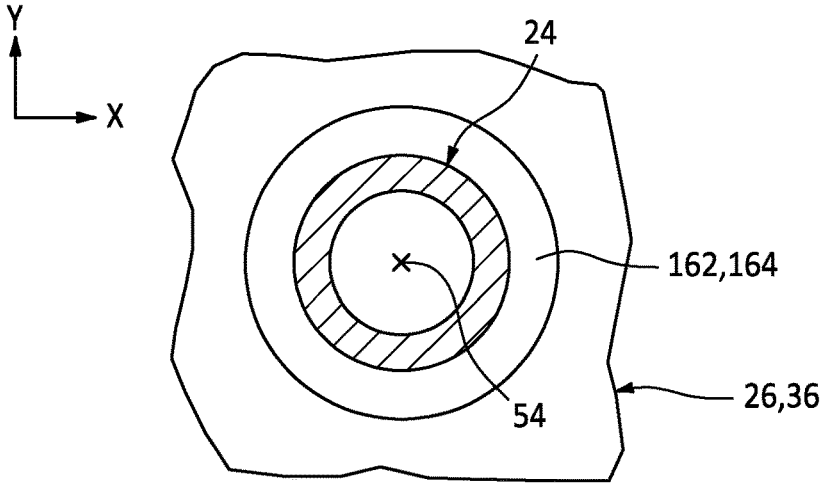
FIG. 12 is an illustration of an annular gap between the fluid conduit and another component.

In some embodiments, referring to FIG. 12, an annular gap 162, 164 may be formed respectively between and thereby (e.g., completely) separate the fluid conduit 24 and each of the brackets 26 and 36.

Figure 13:
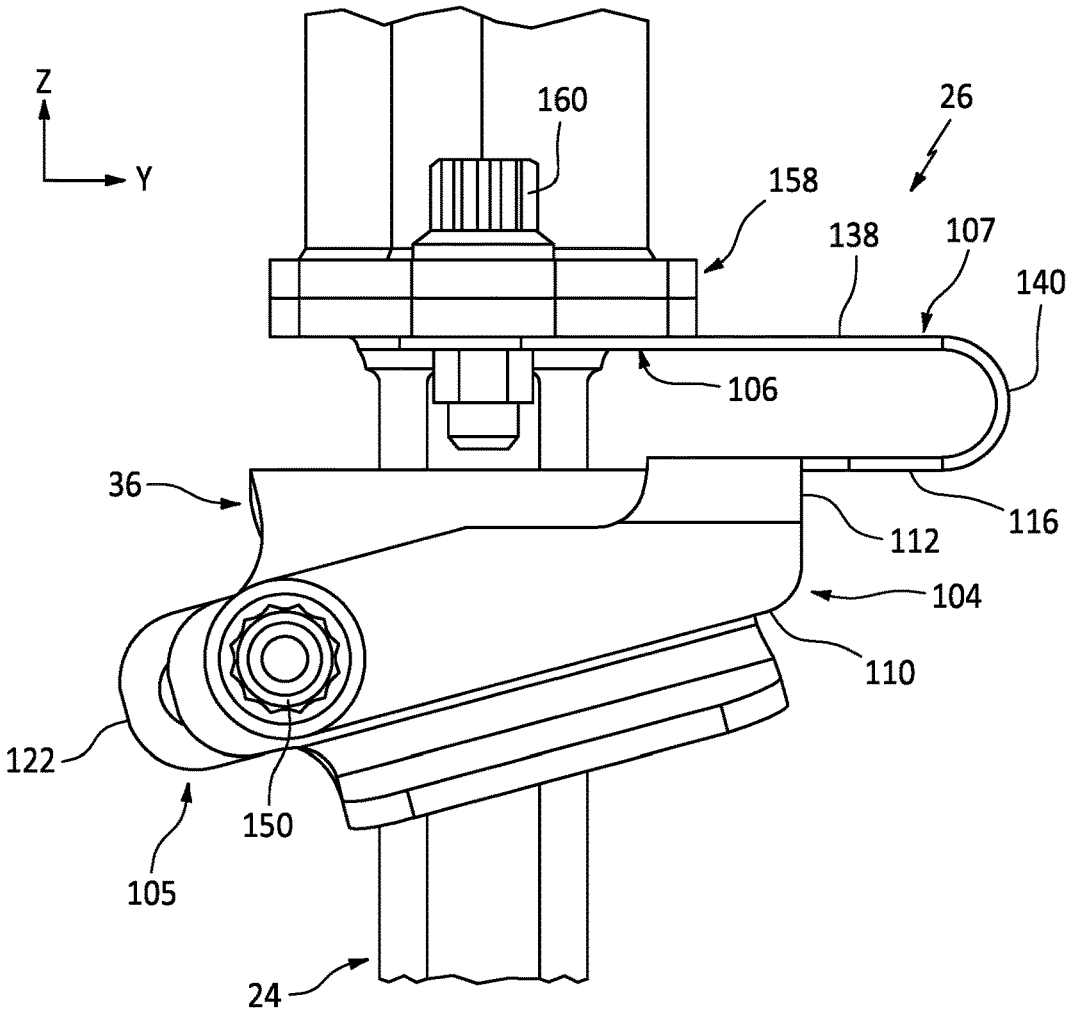
FIG. 13 is an illustration of another damped coupling between the fluid conduit and the static structure.
Figure 14:
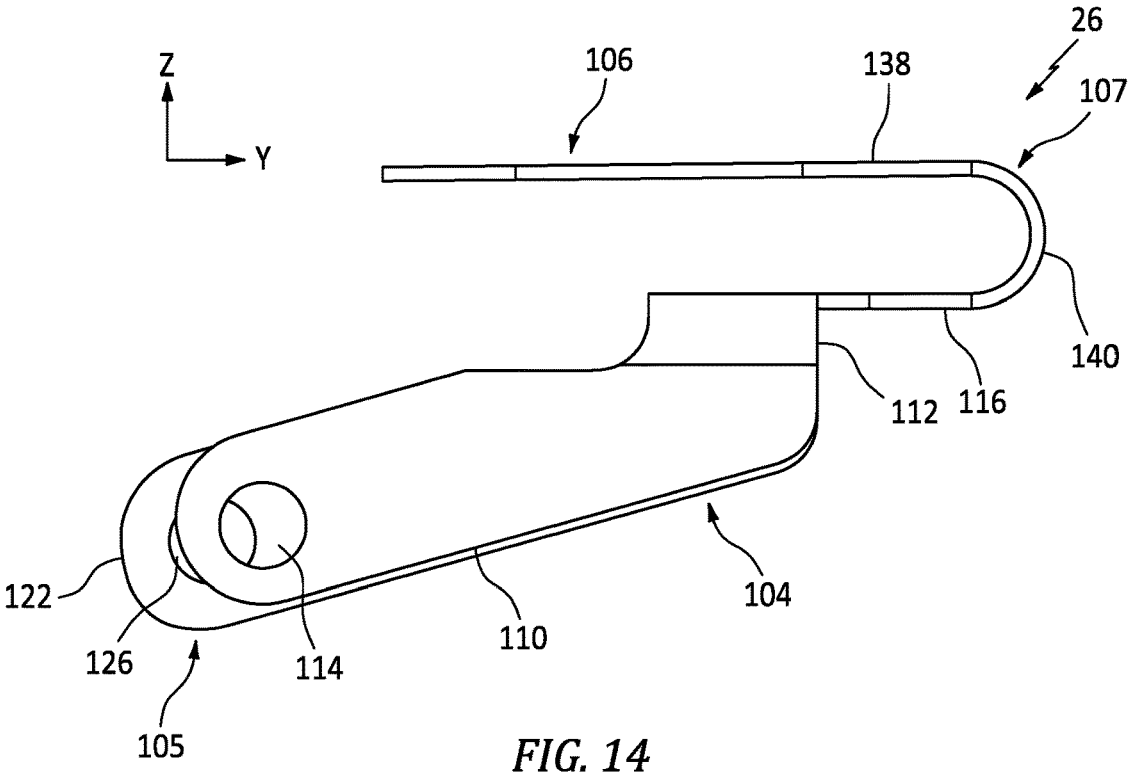
FIGS. 14 and 15 are illustrations of different views of another conduit bracket.
Figure 15:
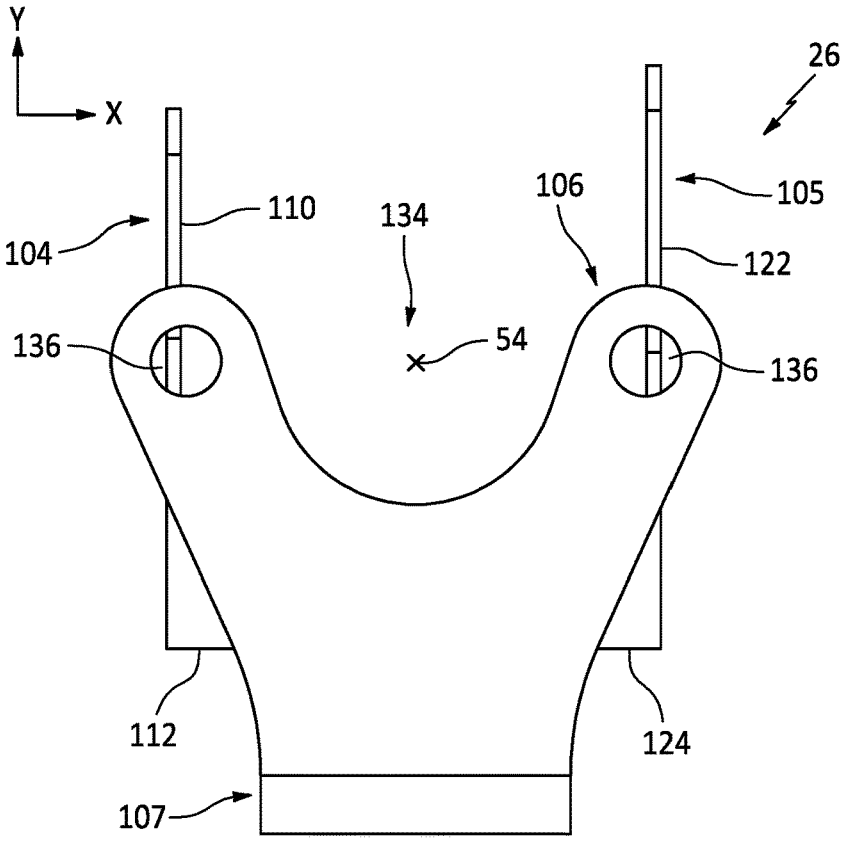

In some embodiments, referring to FIGS. 5 and 6, the conduit bracket 26 may include multiple dampers 107 and 108. In other embodiments, referring to FIGS. 13-15, the conduit bracket 26 may include a single damper; e.g., 107.

In some embodiments, referring to FIGS. 5, 7 and 8, each damper 107, 108 may be configured with a single base mount 104, 105. In other embodiments, referring to FIGS. 13-15, the damper 107 may be configured with each of the base mounts 104 and 105. In the embodiment of FIGS. 12-15, the base mounts 104 and 105 are disposed on opposing lateral sides of the damper 107. Each base mount extension 112, 124 extends between and is connected to the respective base mount flange 110, 122 and the damper inner leg 116.

The conduit bracket 26 is described above as coupling to the base bracket 36. However, it is contemplated the base bracket 36 may be omitted and the conduit bracket 26 and one or more of its mounts 104, 105 may alternatively be coupled (e.g., directly) to the outer case 28. The conduit bracket 26 and one or more of its mounts 104, 105, for example, may be welded, brazed or otherwise bonded (or mechanically attached) to the outer case 28 or another feature of the static structure 22.

Figure 16:
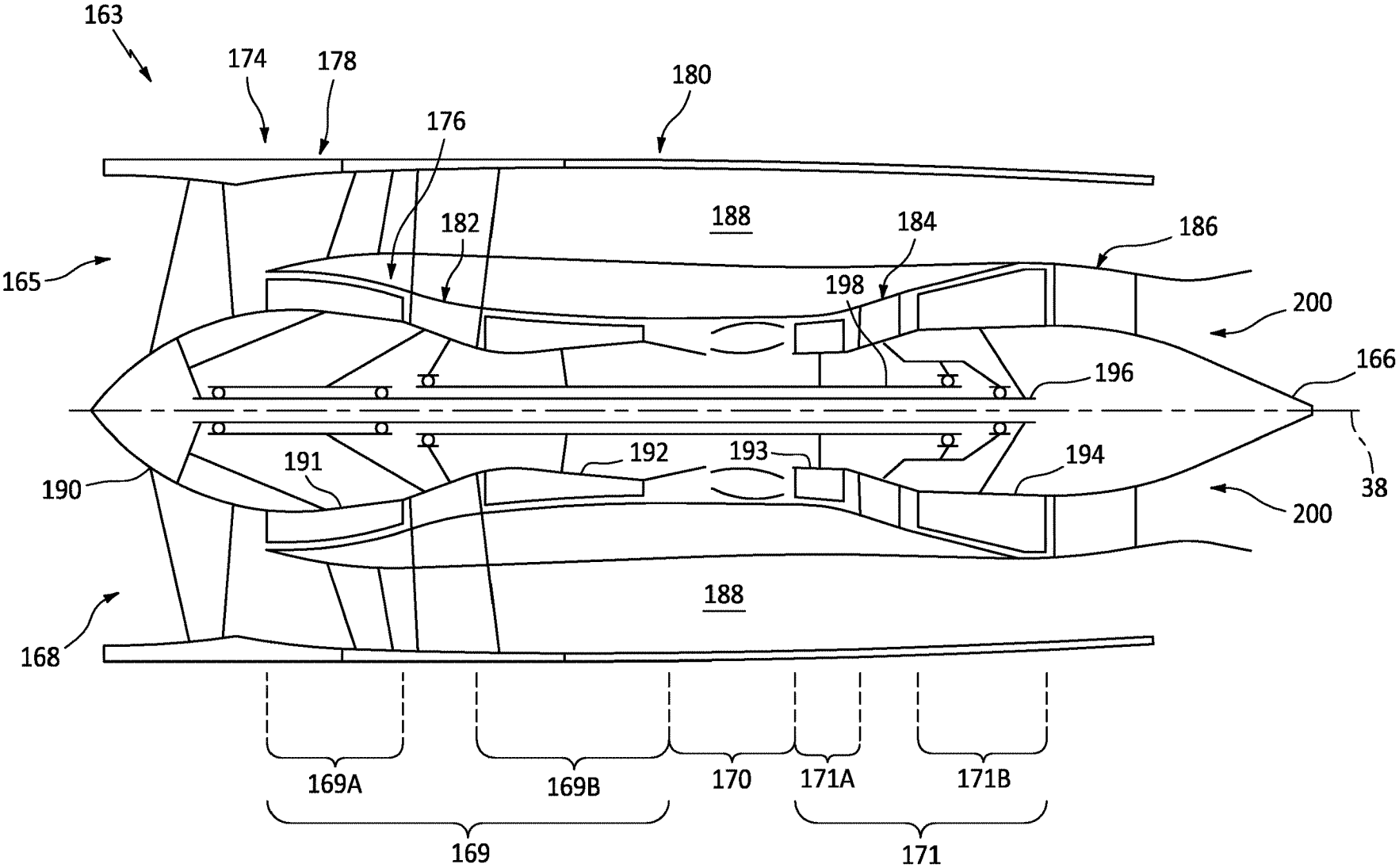
FIG. 16 is a schematic, side sectional illustration of a gas turbine engine.

FIG. 16 is a side sectional illustration of a turbofan gas turbine engine 163, which turbine engine 163 may include the turbine engine assembly 20 described above. This turbine engine 163 extends along the axial centerline 38 between an upstream airflow inlet 165 and a downstream exhaust center body 166. The turbine engine 163 includes a fan section 168, a compressor section 169, a combustor section 170 and a turbine section 171. The compressor section 169 includes a low pressure compressor (LPC) section 169A and a high pressure compressor (HPC) section 169B. The turbine section 171 includes a high pressure turbine (HPT) section 171A and a low pressure turbine (LPT) section 171B.

The engine sections 168-171B are arranged sequentially along the axial centerline 38 within an engine housing 174. The engine housing 174 includes an inner housing structure 176, an outer housing structure 178 and a bypass duct 180. The inner housing structure 176 is configured to house and/or support one or more components of a core of the turbine engine 163, which engine core includes the compressor section 169, the combustor section 170 and the turbine section 171. The inner housing structure 176 may include a compressor support structure 182 (e.g., a mid-compressor frame), a turbine support structure 184 (e.g., a mid-turbine frame) and a turbine exhaust case 186 (TEC), where any of these components 182, 184, 186 may be configured as the static structure 22 of FIG. 1. The outer housing structure 178 is configured to house and/or support the fan section 168 and the engine core. The bypass duct 180 is configured to form a (e.g., annular) bypass flowpath 188 that provides a bypass around (e.g., radially outside of and axially along) the engine core.

Each of the engine sections 168, 169A, 169B, 171A and 171B includes a respective rotor 190-194. Each of these rotors 190-194 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 190 and the LPC rotor 191 are connected to and driven by the LPT rotor 194 through a low speed shaft 196. The HPC rotor 192 is connected to and driven by the HPT through a high speed shaft 198. These engine shafts 196 and 198 (e.g., rotor drive shafts) are rotatably supported by a plurality of bearings. Each of these bearing is connected to the engine housing 174 by at least one static support structure.

During operation of the turbine engine 163 of FIG. 16, air enters the turbine engine 163 through the airflow inlet 165. This air is directed through the fan section 168 and into a (e.g., annular) core flowpath 200 and the bypass flowpath 188. The core flowpath 200 extends sequentially through the engine sections 169A-171B. The air within the core flowpath 200 may be referred to as "core air". The air within the bypass flowpath 188 may be referred to as "bypass air".

The core air is compressed sequentially by the LPC rotor 191 and the HPC rotor 192, and directed into a combustion chamber of a combustor in the combustor section 170. Fuel is injected into the combustion chamber and mixed with the compressed core air to provide a fuel-air mixture. This fuel air mixture is ignited and combustion products thereof flow through and sequentially cause the HPT rotor 193 and the LPT rotor 194 to rotate. The rotation of the HPT rotor 193 and the LPT rotor 194 respectively drive rotation of the HPC rotor 192 and the LPC rotor 191 and, thus, compression of the air received from a core flowpath inlet. The rotation of the LPT rotor 194 also drives rotation of the fan rotor 190, which propels bypass air through and out of the bypass flowpath 188. The propulsion of the bypass air may account for a majority of thrust generated by the turbine engine 163.

The turbine engine assembly 20 may be included in various turbine engines other than the one described above. The turbine engine assembly 20, for example, may be included in a geared turbine engine where a gear train connects one or more shafts to one or more rotors in a fan section, a compressor section and/or any other engine section. Alternatively, the turbine engine assembly 20 may be included in a turbine engine configured without a gear train. The turbine engine assembly 20 may be included in a geared or non-geared turbine engine configured with a single spool, with two spools (e.g., see FIG. 16), or with more than two spools. The turbine engine may be configured as a turbofan engine, a turbojet engine, turboprop engine, a turboshaft engine, a propfan engine, a pusher fan engine, an auxiliary power unit (APU) or any other type of turbine engine. The present disclosure therefore is not limited to any particular types or configurations of turbine engines.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a turbine engine, comprising:

a static structure of the turbine engine, the static structure comprising a port;

a conduit extending longitudinally through the port; and a conduit bracket coupling the conduit to the static structure, the conduit bracket comprising a base mount attached to the static structure;

a conduit mount attached to the conduit; and a damper between the base mount and the conduit mount, the damper including a first leg, a second leg and a web;

the first leg projecting laterally out from the base mount;

the second leg projecting laterally out from the conduit mount; and the web longitudinally between and connected to the first leg and the second leg.

2. The assembly of claim 1, wherein the static structure comprises a turbine exhaust case.

3. The assembly of claim 1, wherein the static structure comprises a turbine engine case and a base bracket;

the port extends through a sidewall of the turbine engine case; and the base bracket is connected to the sidewall of the turbine engine case, and the conduit bracket is attached to the base bracket.

4. The assembly of claim 3, wherein the base bracket comprises a second port; and the conduit extends longitudinally through the second port.

5. The assembly of claim 3, wherein the base bracket comprises a base bracket first mount attached to the turbine engine case;

a base bracket second mount attached to the turbine engine case; and a channeled segment laterally between and connected to the base bracket first mount and the base bracket second mount;

wherein the base mount is attached to a lateral side of the channel segment.

6. The assembly of claim 1, wherein the first leg is parallel with the second leg.

7. The assembly of claim 1, wherein the first leg is longitudinally spaced from and laterally overlaps the second leg.

8. The assembly of claim 1, wherein the web is configured with a curved cross-sectional geometry.

9. The assembly of claim 1, wherein the base mount comprises a base mount flange mechanically fastened to the static structure.

10. The assembly of claim 9, wherein the base mount further comprises an extension that projects laterally and longitudinally out from the base mount flange to the first leg.

11. The assembly of claim 1, wherein the conduit bracket further comprises a second base mount;

a portion of the static structure is laterally between and mechanically fastened to the base mount and the second base mount.

12. The assembly of claim 11, wherein the base mount includes a first base mount flange and a first extension, and the first extension projects laterally and longitudinally out from the first base mount flange to a first side of the first leg; and the second base mount includes a second base mount flange and a second extension, and the second extension projects laterally and longitudinally out from the second base mount flange to a second side of the first leg.

13. The assembly of claim 1, wherein the conduit bracket further comprises a second base mount attached to the static structure; and a second damper between the second base mount and the conduit mount, the second damper including a second damper first leg, a second damper second leg and a second damper web;

wherein the second damper first leg projects laterally out from the second base mount;

wherein the second damper second leg projects laterally out from the conduit mount; and wherein the second damper web is longitudinally between and connected to the second damper first leg and the second damper second leg.

14. The assembly of claim 13, wherein a centerline of the damper is angularly offset from a centerline of the second damper by an angle greater than zero degrees and less the one-hundred and eighty degrees.

15. The assembly of claim 1, wherein the conduit mount comprises a second port; and the conduit extends longitudinally through the second port.

16. The assembly of claim 1, wherein the conduit mount comprises a channel; and the conduit extends longitudinally through the channel.

17. A bracket for mounting a conduit to a component of a turbine engine, the bracket comprising:

a first base mount configured to mechanically fasten to a first side of the component;

a second base mount configured to mechanically fasten to a second side of the component;

a conduit mount comprising an aperture configured to receive the conduit therethrough, the conduit mount configured to mechanically fasten to the conduit;

a first damper between and connected to the first base mount and the conduit mount; and a second damper between and connected to the second base mount and the conduit mount, the second damper angularly offset from the first damper by an angle between forty-five degrees and one-hundred and thirty-five degrees.

18. The bracket of claim 17, wherein at least the first base mount, the second base mount, the conduit mount, the first damper and the second damper are configured together as a monolithic body.

19. A bracket for mounting a conduit to a component of a turbine engine, the bracket comprising:

a first base mount comprising a first fastener aperture, the first base mount configured to mechanically fasten to a first side of the component;

a second base mount comprising a second fastener aperture, the second base mount configured to mechanically fasten to a second side of the component;

a conduit mount comprising an aperture configured to receive the conduit therethrough, the conduit mount configured to mechanically fasten to the conduit; and a damper between and connected to the first base mount, the second base mount and the conduit mount;

wherein at least the first base mount, the second base mount, the conduit mount and the damper are configured together as a monolithic body.

20. The bracket of claim 19, wherein the damper comprises:

a first leg projecting out from the first base mount and the second base mount to a first leg end;

a second leg projecting out from the conduit mount to a second leg end; and a web between the first leg and the second leg, the web connected to the first leg at the first leg end, and the web connected to the second leg at the second leg end.

* * * * *